United States Patent [19]

Eade et al.

[11] 4,278,145

[45] Jul. 14, 1981

[54] CONCERT SHELL

[76] Inventors: Robert A. Eade, 9 Fresh Meadow Rd., Easton, Conn. 06612; Peter V. C. Quaintance, 1650 Jones, San Francisco, Calif. 94109

[21] Appl. No.: 53,517

[22] Filed: Jun. 29, 1979

[51] Int. Cl.[3] ..... E04B 1/99

[52] U.S. Cl. ..... 181/30; 160/135; 40/606

[58] Field of Search ..... 181/30, 284, 287, 295, 181/210; 160/182, 183, 135; 52/144, 145; 40/606

[56] References Cited

U.S. PATENT DOCUMENTS

| | | | |
|---|---|---|---|
| 1,611,483 | 12/1926 | Newsom | 52/144 |
| 1,845,080 | 2/1932 | Eyring et al. | 181/30 |
| 3,180,446 | 4/1965 | Wenger | 181/30 |
| 3,232,370 | 2/1966 | Jaffe | 181/30 |
| 3,316,999 | 5/1967 | Jaffe et al. | 181/30 |

FOREIGN PATENT DOCUMENTS

| | | | |
|---|---|---|---|
| 236287 | 11/1961 | Australia | 181/30 |

*Primary Examiner*—John Gonzales
*Assistant Examiner*—Benjamin R. Fuller
*Attorney, Agent, or Firm*—Arthur T. Fattibene

[57] ABSTRACT

A concert shell for use either indoors or outdoors wherever music is performed so as to enhance the acoustical quality of the music, and which shell is readily portable, light weight, and which can be readily assembled and disassembled. It comprises a plurality of similarly constructed sections wherein each section is formed of structural members having connected thereto an acoustical shell surface which is formed with a compound convex-concave surface arranged to reverberate and mix the sounds to provide for optimum acoustics.

7 Claims, 14 Drawing Figures

FIG. 4
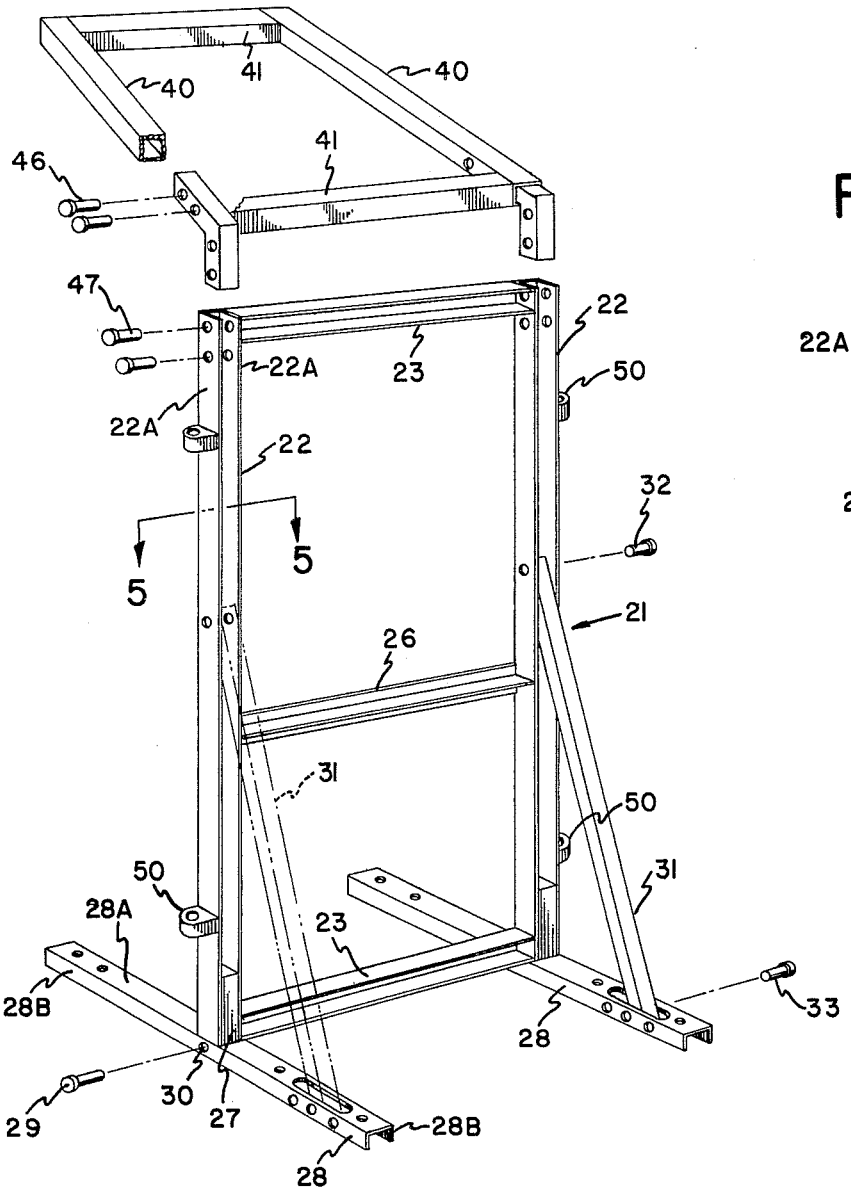
FIG. 10
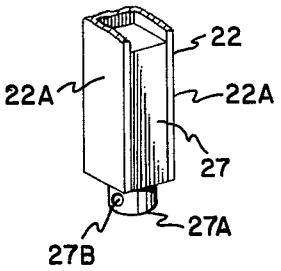
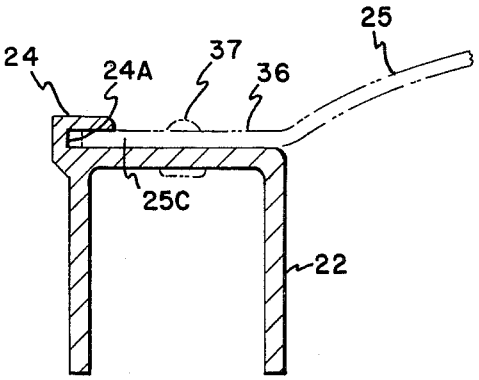
FIG. 5
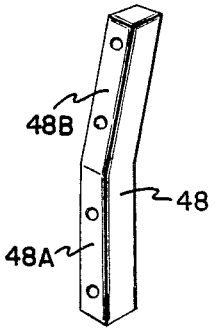
FIG. 9
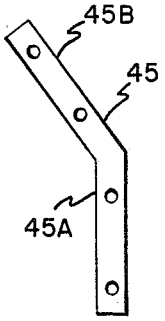
FIG. 7
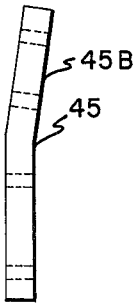
FIG. 8

CONCERT SHELL

PRIOR ART

Various efforts have been made to provide a Concert Shell which could be readily set up to provide a back drop for a band stand where the accoustics of a particular setting is so required. U.S. Pat. Nos. 3,316,999 and 3,232,370 comprise known patented art structures directed to concert shells of the type to which this invention relates. Generally, such concert shells had limited application as they were particularly suitable for either indoor use or outdoor use, and therefore not readily adapted for both types of uses. Also, the known constructions were relatively complicated in structure and relatively costly.

OBJECTS

An object of this invention is to provide a Concert Shell which can be formed to any desired size by linking together a plurality of similarly constructed sections.

Another object is to provide a Concert Shell section which is relatively simple in construction and relatively inexpensive to fabricate.

Another object is to provide a Concert Shell having an improved accoustical surface contour.

Another object is to provide a Concert Shell which is constructed for either indoor or outdoor use.

Another object is to provide a Concert Shell construction which is light weight.

Another object is to provide a Concert Shell made of a plurality of like sections which are rendered readily nestable and stackable so as to occupy a minimum of space during storage and/or shipping.

Another object is to provide a Concert Shell section having an accoustical surface which will function so as to enable the musician to hear themselves and each other and to blend the resulting sounds into a musical whole.

BRIEF SUMMARY OF THE INVENTION

The foregoing objects and other features and advantages of this invention are attained by a Concert Shell which is made up of a plurality of individual, similiarly constructed sections. Each section is formed of a lower elongated portion having connected thereto an upper portion which may be either cantilevered or vertically extended relative to the lower portion. The arrangement is such that the respective cantilever upper portion or vertical upper portion can be interchangeably connected to the lower portion.

The respective connected upper and lower portion are secured to a base portion which is sufficiently broad so as to withstand considerable wind resistance. The respective upper and lower portion are each defined by rectangularly connected structural members to which there is connected an accoustical surface. In accordance with this invention the accoustical surface comprises a sheet of plastic material or the like having one or more "blister" or "bubble" shaped configurations, the major portion of which having a convex-concave cross sectional shape which projects outwardly from the plane of the surface or sheet.

The arrangement is such that a plurality of like sections are linked together so that the respective sections can be connected to define a desired shaped back-drop. When the respective sections defining the back-drop are disassembled, they can be readily nested and stacked to minimize storage and/or shipping space.

FEATURES

A feature of the invention resides in the provision of a Concert Shell section which is constructed so as to define a variety of differently shaped back drops.

Another features resides in a Concert Shell back drop having an improved accoustical surface construction.

Another feature resides in a Concert Shell construction formed of a plurality of like shell sections which are provided with one or more optional or variable upper panel portions.

Another feature resides in the provision of a Concert Shell which combines high accoustical performance with versatility and convenience.

Other features and advantages will become more readily apparent when considered in view of the drawings and specifications.

FIG. 4 is a detail perspective view illustrating the structural frame portion of the Concert Shell section of FIG. 3, with the accoustical surface removed.

FIG. 5 is a sectional view taken along line 5—5 on FIG. 4, with the accoustical surface shown in dash dot line.

FIG. 7 is a detail side view of the connector for the upper shell or panel portion.

FIG. 8 is a detail front view of the connector of FIG. 7.

FIG. 9 is a detail of a modified connector.

FIG. 10 is a construction detail of the feet section of the panel or shell construction of FIGS. 3 and 4.

DETAIL SPECIFICATIONS

Figure 1:
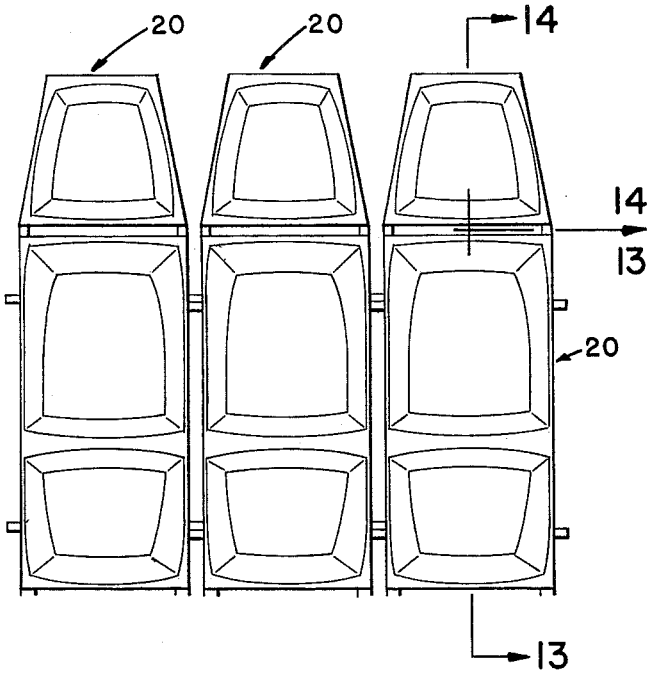
FIG. 1 is a front elevation view of a fragmentary portion of a Concert Shell made of shell sections embodying the invention, in an erected position.
Figure 11:
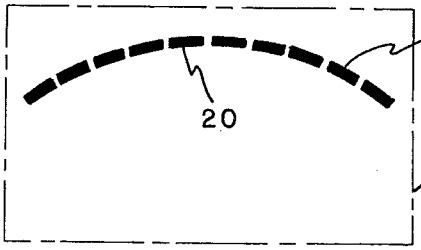
FIG. 11 illustrates a schemmatic plan view of a plurality of shell sections disposed to form a curvilinear back drop.
Figure 12:
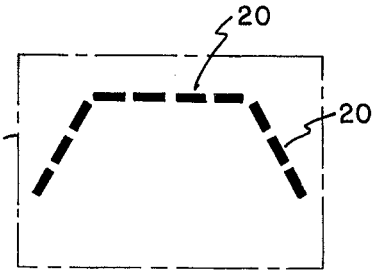
FIG. 12 illustrates another form of the invention wherein the shell section are arranged to define an angular back drop.

Referring to the drawings there is shown in FIG. 1, a plurality of shell sections 20 which are hinged together, as will be hereinafter described, to define a back drop for a band stand. The respective shell sections 20 may be hinged together to define a curvilinear back drop as schemmatically shown in FIG. 11 or angularly disposed as shown in FIG. 12. However, it will be understood that the respective shell section 20 may be joined in any desired sequence or series as may be desired in a particular setting.

In accordance with the invention, each section 20 is similarly constructed. For example, referring to FIGS. 3 and 4, each section 20 is made up of a lower portion 20A and an upper portion 20B; the upper portion 20B being shown as being cantileverely connected to extend upwardly and outwardly relative to the lower portion 20A.

As best seen in FIG. 4, the frame 21 defining the lower portion 20A is defined by rectangularly disposed structural opposed side members 22—22 and end members 23—23. In the illustrated embodiment, each side and end members 22 and 23 is formed as a channel shape member; see FIG. 5. Extending longitudinally about the outer edge portion of each member 22 and 23 is a marginal lip or flange 24 to define a circumscribing groove or channel 24A for receiving the peripheral edge portion of the accoustical panel 25. Interconnected, intermediately the height of the frame 21 is a cross piece 26.

As shown in FIG. 10, each of the side members 22—22 is provided with a foot portion 27. The foot portion 27 comprises a bar which is connected between the opposed web portions 22A—22A of the side member 22, the bar 27 having an extended portion 27A which is arranged to be received in an opening formed in an associated base member 28.

As best seen in FIG. 4, the base member 28 comprises a transversely extending elongated channel shaped member having a web portion 28A and depending connected side web portions 28B. Thus, as seen in FIG. 4, the lower frame 21 is perpendicularly disposed relative to the opposed base members 28—28 in the erected position. The lower frame 21 is secured to the base members 28—28 by a pin 29 which is extended transversely through aligned openings 30 formed in the side web portion 28B and opening or hole 27B formed in foot 27. To maintain the frame member 21 in the erected position, a diagonal brace 31 is provided. The brace 31 is also formed of a channel shaped member, the upper end portion being received between the web portion 22A—22A of the side members 22—22 and releaseably connected thereto by a pin 32. The lower end of the brace 31 extends into an opening formed in a base member 28; and releaseably attached thereto by a pin 33.

Figure 3:
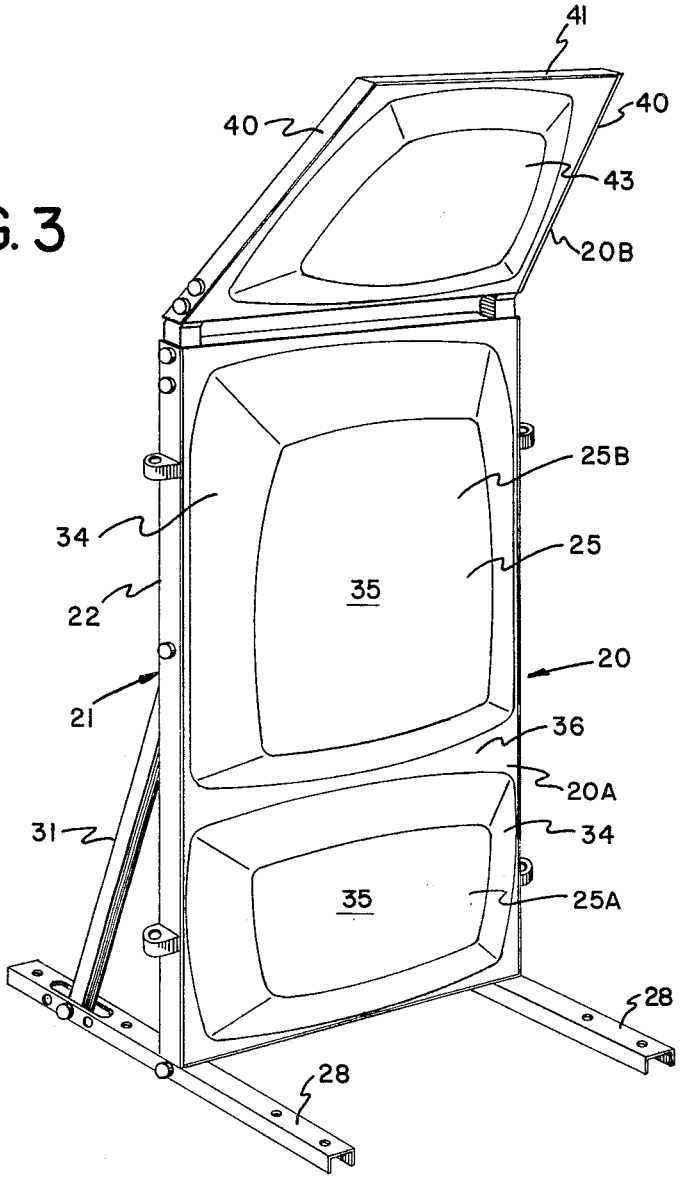
FIG. 3 is a detail perspective view of a shell section embodying the invention.

As best seen in FIGS. 1 and 3 the accoustical panel 25 is formed of a light weight, sheet material such as plastic which is formed to reflect and disperse the sounds produced by a band or orchestra. In the illustrated form, the panel 25 is formed with an upper and lower outwardly projecting "blister" or "bubble" 25A and 25B. As shown the respective "bubbles" or "blister" are each formed with circumscribing side portions 34 which project radically outwardly from the plane of the panel 25. The face 35 of the "blister" is curvilinear along its respective X and Y axis. In the illustrated embodiment the lower "blister" is smaller than the upper "blister" and the separation 36 between the two is located at a height or a level of the musician. Circumscribing the panel 25 in the plane therein is a marginal flange 36 which is adapted to be received with the lip flange 24 and abutt against the transverse web portion of the frame members 22 and 23. As shown in FIG. 5, the marginal flange 36 of the panel 25 is secured to the associated structural member by rivots or fasteners 37 spaced along the flange 36.

Figure 13:
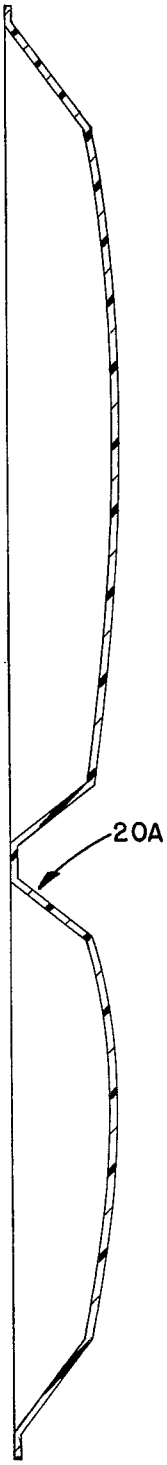
FIG. 13 is a sectional view taken along line 13—13 on FIG. 1.
Figure 14:
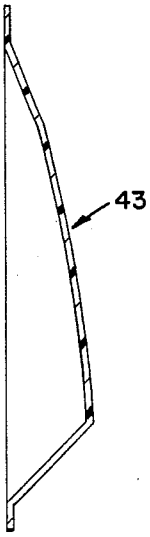
FIG. 14 is a sectional view taken along line 14—14 on FIG. 1.

Referring to the drawings FIGS. 13 and 14, it will be noted that the accoustical panel 25 of the lower portion of the shell section is defined by a marginal flange 25C. The panel 25 is further formed with a pair of outwardly projecting "blisters" which are generally similar in construction but opposite in hand, with the upper one being elongated in comparison to the lower blister. The separation 36 between the upper and lower blister is located at approximately the height at which the musicians would be placed before it. Each blister is defined with a sharply angled end wall portion 34 which defines a generally frustro pyramadical shape in which the respective end walls are curvilinear, and which end walls 34 merge into an end face 35 forming a shallow convex surface which is curvilinear in the X and Y axis.

The panel defining the upper shell portion 20B is formed with a single "blister" formation which is generally similar to the configuration of the lower "blister" of panel 25. However, as seen in FIG. 14, the side edges of the upper panel are tapered toward the outer or free end thereof.

Referring to FIG. 13, it will be noted that the lower wall portion of the "blister" is disposed as a greater angle relative to the plane of the panel than the opposed upper end wall portion. Thus the face of the blister tends to slope upwardly or toward the plane of the panel at the upper end thereof.

Figure 6:
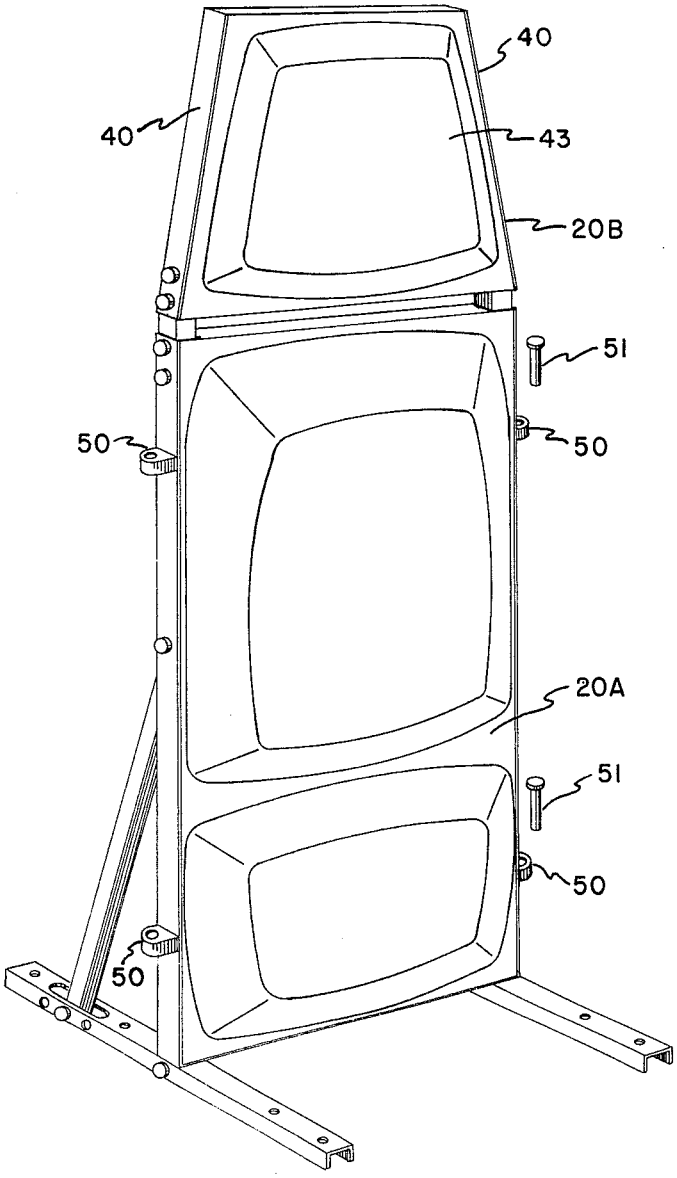
FIG. 6 is a perspective view of a modified form of the invention.

Shell section 20A may be extended by a detachably connecting upper shell section 20B which may be cantilever as shown in FIGS. 3 and 4, or may extend vertically as seen in FIG. 6. It will be understood that the upper portion 20A as shown in FIGS. 3 and 6 are identical in construction. Whether the upper portion 20B is disposed vertically as seen in FIG. 6 or inclined as seen in FIG. 3 is determined by the connector provided between the upper and lower portions 20A and 20B.

Referring to FIG. 4, the upper portion 20B is defined by opposed channel members 40—40 and 41—41. These channel members 40 and 41 have a similar cross section as defined with respect to FIG. 5, and an accoustical panel 43 is connected to the upper frame members 40 and 41 in a manner as herein described. The accoustical panel 43 is also similarly formed of sheet material having an outwardly projecting "blister" or "bubble" having a radically projecting curvilinear circumscribing edge and a connected face or front which is curvilinear along its X and Y axis.

FIGS. 7 and 8 illustrate a connector 45 by which the upper portion 20B is cantileverily supported to the lower portion 20B. The connector 45 comprises an angularly shaped bar having a lower leg portion 45A and a upper leg portion 45B. The shape of the bar or connector is such that the upper leg portion 45B can be received between the opposed web portions of the side channels 40—40 of the upper frame. The lower leg portion 45B is adapted to be received between the web portion 22A—22A of the side members 22—22 of the lower frame. Pins 46 and 47 secure the respective connector legs 45A and 45B to the respective frame portions. As best seen in FIG. 8 it will be noted that the upper leg 45 is bent slightly inwardly so as to accommodate the angularly disposed side members 40—40 of the upper frame as side members 40—40 tend to converge toward their outer ends, as best seen in FIG. 1.

To extend the upper portion 20B vertically relative to the lower portion 20A, the connector 48 is defined as a straight bar in which the lower portion 48A is received between the web portion of the side members 22—22 of the lower frame and the upper portion 48B is received between the opposed web portion of side members 40—40 of the upper frame. The connector 48 is secured to the respective frame members by pins 46 and 48. It will thus be apparant that the upper portion 20B is connected to a lower portion 20A to project outwardly as shown in FIG. 3 or vertically as in FIG. 6 simply by the selection of the appropriate connector 45 or 48.

The respective sections 20 in the erected position are serially connected to define the appropriate back drop setting. This is attained by providing the side frame members 22—22 with complementary lugs 50; which when placed in side-by side arrangement; the lugs 50 on one section will overly the complementary lug on the next adjacent section so that by inserting a pin 51 through the aligned lugs 50, the adjacent sections can be joined.

From the foregoing, it will be noted that the respective component parts can be readily assembled and disassembled without the use of any tools, and in a simple and expedient manner of merely pinning complementary portions together. Also, the accoustical panels with the "blister" or "bubble" configuration provides an optimum blending and balancing of the accoustical energy.

Figure 2:
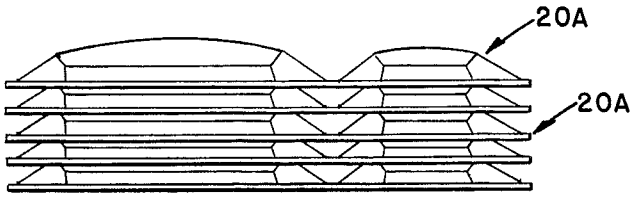
FIG. 2 is a side view showing the sections making up the shell concept in a stacked and stowed position.

Referring to FIG. 2, it will be noted that the shape of the panels or sections 20A is such that they can be readily stacked and nested so as to occupy a minimum of space for storage and/or shipment. The same can be done with the upper sections 20B.

The arrangement in such panel shape combines a high accoustical performance with a striking visual impact, particularly when the back-drop is flooded with lighting.

When the upper cantilevered section 20B is utilized, it is preferred that it be angled at approximately 37° with respect to the vertical.

While the invention has been described with respect to particular embodiments thereof, it will be readily appreciated and understood that variations and modifications may be made without departing from the spirit or scope of the invention.

What is claimed is:

1. A concert shell comprising a plurality of shell sections, each of said shell sections being similarly constructed and each shell section including a lower portion and an upper portion, means for readily detachably connecting the upper portion from said lower portion, a frame having opposed side and end members defining each of said portions, said opposed side and end members having a circumscribing lip to define a groove circumscribing said frame, an accoustical panel mounted on said frame whereby the edges of said panel are received in said groove, means for fixedly connecting said panel to said frame, and said panel connected to said upper portion having at least one outwardly projecting blister having a curvilinear contour extending longitudinally and transversely of said blister; and said panel connected to said lower portion having a plurality of spaced apart outwardly projecting blisters, each of said blister having a compound curvilinear contour along the respective x and y axis thereof, and said spaced blisters of said lower section being spaced apart to define a separation therebetween located at the height of a seated musician.

2. A concert shell as defined in claim 1 wherein the accoustical panel of the lower portion comprises a pair of outwardly projecting blisters having a compound curvilinear contour and which blister are vertically spaced and separated at a height of a seated musician, said pair of blisters being similar in contour but oppositely disposed.

3. A concert shell as defined in claim 2 and including a pair of spaced apart horizontally disposed base members, said opposed side members of said frame having projecting feet portions, said base members having an opening for receiving said feet portions, and a pin extending through said base portions and said foot portions for securing said side members to the corresponding base member.

4. A concert shell section comprising a pair of spaced apart side members and opposed interconnecting end members defining a rectangular shaped frame, each of said members having a channel shaped cross-section, said channel shaped cross-section being defined by a pair of opposed web portions and an interconnecting web portion, a flange lip connected to each of said members, said lip being spaced from the interconnecting web portion to define a groove circumscribing said frame, an accoustical panel, said accoustical panel having a peripheral marginal portion adapted to be received in said circumscribing groove, said accoustical panel includes a pair of integrally formed blisters, each projecting outwardly from the plane of said panel, each said blisters being defined by a relatively sharply angled circumscribing end wall which are generally inclined to define a generally frustro pyramid, the sides of which are generally curvilinear, and a front face connected to said angled end walls defining a generally shallow convex surface that is curvilinear so as to define a compound curve along the x and y axis of said front face, said blisters having their contiguous end walls spaced apart to define a separation located at the height of a seated musician, means for securing said marginal portion of said panel to the adjacent interconnecting web portion of said frame members, a foot portion extending beyond the lower end of said side members, a pair of horizontally disposed base members, said base members each comprising an elongated channel shaped member having an opening intermediate the ends thereof adapted for receiving said foot portions of said frame, a diagonal bracket interconnected between said side members and its corresponding base members.

5. A concert shell section as defined in claim 4 and including an upper section, said upper section including oppositely disposed side and end members to define an upper frame portion, and an accoustical panel having a compound curvilinear projecting blister connected to said upper frame portion, and means for connecting said upper frame portion to said first mentioned frame.

6. A concert shell section as defined in claim 5 wherein said latter means comprises a detachable angled connector whereby said upper frame portion is supported at an angle relative to said first mentioned frame.

7. A concert shell section as defined in claim 5 wherein said latter means comprises a detachable connector shaped so as to support said upper frame portion as a vertical extension of said first mentioned frame.

* * * * *